US009139033B2

(12) United States Patent
Ebihara

(10) Patent No.: US 9,139,033 B2
(45) Date of Patent: Sep. 22, 2015

(54) IMAGE FORMING APPARATUS

(71) Applicant: Takashi Ebihara, Ibaraki (JP)

(72) Inventor: Takashi Ebihara, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/061,048

(22) Filed: Oct. 23, 2013

(65) Prior Publication Data

US 2014/0146108 A1 May 29, 2014

(30) Foreign Application Priority Data

Nov. 26, 2012 (JP) ..... 2012-258039

(51) Int. Cl.
*B41J 29/393* (2006.01)
*B41J 29/13* (2006.01)

(52) U.S. Cl.
CPC ..... *B41J 29/393* (2013.01); *B41J 29/13* (2013.01)

(58) Field of Classification Search
CPC ..... B41J 29/13; B41J 29/38; B41J 29/387
USPC ..... 347/19
See application file for complete search history.

(56) References Cited

U.S. PATENT DOCUMENTS 4,844,630 A * 7/1989 Hagen et al. ..... 400/54
5,207,521 A * 5/1993 Ricca et al. ..... 400/647.1
6,065,831 A * 5/2000 Kawaura et al. ..... 347/108
7,334,861 B2 * 2/2008 Ha ..... 347/19
7,431,447 B2 * 10/2008 Jensen ..... 347/108
2006/0044336 A1 3/2006 Asanuma
2012/0147071 A1 * 6/2012 Ortmann et al. ..... 347/4

FOREIGN PATENT DOCUMENTS

CN 101039367 A 9/2007
CN 102223461 A 10/2011
JP 2001-246806 9/2001
JP 2006-248025 9/2006
JP 2006248025 A * 9/2006
JP 2007-328167 12/2007
JP 2009-248316 10/2009

* cited by examiner

*Primary Examiner* — Alessandro Amari
*Assistant Examiner* — Michael Konczal
(74) *Attorney, Agent, or Firm* — Cooper & Dunham LLP

(57) ABSTRACT

An image forming apparatus includes an access cover that opens/closes relative to an apparatus body, a carriage that includes an image forming device and moves in a moving area which is exposed when the cover is opened, a first detector that detects that the cover has been opened from a fully closed position to a first position, a second detector that detects that the cover has been opened to a second position at which the cover is more open than at the first position, a drive source that drives the carriage to move, and a controller that brakes the drive source while the drive source is supplied with power when the first detector detects that the cover has been opened to the first position, and cuts off power supply to the drive source when the second detector detects that the cover has been opened to the second position.

11 Claims, 14 Drawing Sheets

IMAGE FORMING APPARATUS

CROSS-REFERENCE TO RELATED APPLICATION

This patent application is based on and claims priority pursuant to 35 U.S.C. §119 to Japanese Patent Application No. 2012-258039, filed on Nov. 26, 2012, in the Japan Patent Office, the entire disclosure of which is hereby incorporated by reference herein.

BACKGROUND

1. Technical Field

The present invention relates to an image forming apparatus.

2. Related Art

An inject recording apparatus is an example of an image forming apparatus, such as a printer, a facsimile machine, a copier, a plotter, or a multifunction machine combining the functions of these apparatuses, employing a liquid ejection recording system in which a liquid ejection head (i.e., liquid droplet ejection head) that ejects droplets is used as a recording head.

Such an image forming apparatus includes an access cover configured to open and close relative to the body of the apparatus. The access cover is closed during a printing operation to prevent an internal mechanical section of the apparatus including a carriage mounted with an image forming device from being accessed by a user, for example, and is opened in the event of a jam or the like to allow the internal mechanical section to be accessed.

To prevent the access cover from being opened during the printing operation, the image forming apparatus may include, for example, a cover locking mechanism for locking the access cover and an interlock switch actuated by the access cover.

In the configuration including the cover locking mechanism for locking the access cover, however, the access cover may be damaged if the user attempts to forcibly open the access cover.

Further, if the access cover is opened during the printing operation, the internal mechanical section becomes accessible by the user, as described above. If the carriage is moving when the access cover is opened, therefore, it is desirable to immediately stop the movement of the carriage.

Therefore, the supply of power to a drive source for moving the carriage may be cut off upon detection of the open state of the access cover by a cover open sensor. Even if the supply of power to the drive source is cut off, however, the carriage continues to move by inertia and thus is insufficiently reduced in speed. As a result, the carriage may come into contact with the user.

SUMMARY

In view of the above-described issues, it is an object of the present invention to promptly and reliably stop a carriage when an access cover is opened.

The present invention provides an improved image forming apparatus that, in one example, includes an access cover, a carriage, a first detector, a second detector, a drive source, and a controller. The access cover is configured to open and close relative to a body of the image forming apparatus. The carriage is configured to include an image forming device and move in a moving area inside the image forming apparatus which is exposed when the access cover is opened. The first detector is configured to detect that the access cover has been opened from a fully closed position to a first position. The second detector is configured to detect that the access cover has been opened to a second position at which the access cover is more open than at the first position. The drive source is supplied with power and configured to drive the carriage to move. The controller brakes the drive source while the drive source is being supplied with power when the first detector detects that the access cover has been opened to the first position, and cuts off power supply to the drive source when the second detector detects that the access cover has been opened to the second position.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION

Figure 1:
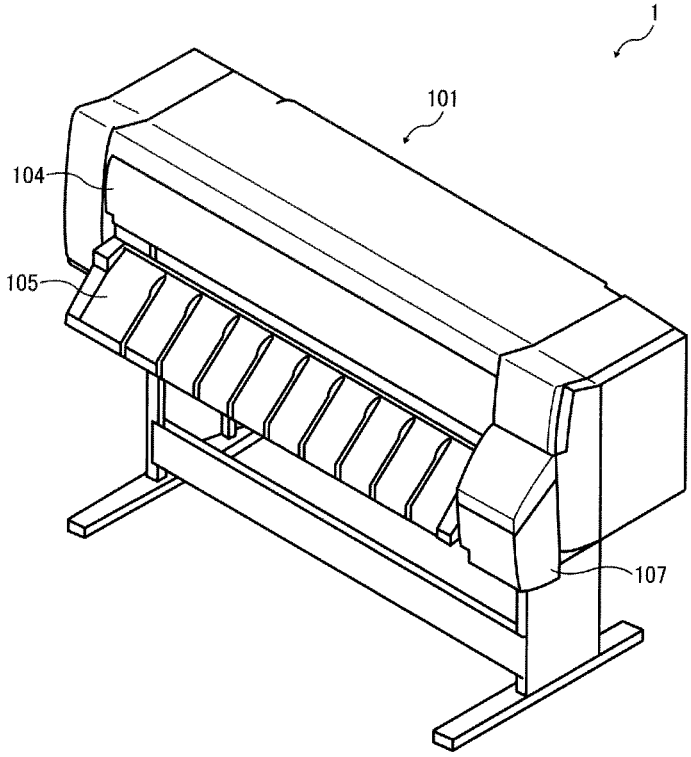
FIG. 1 is an external perspective view of an image forming apparatus according to an embodiment of the present invention.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views, embodiments of the present invention will be described.

Figure 2:
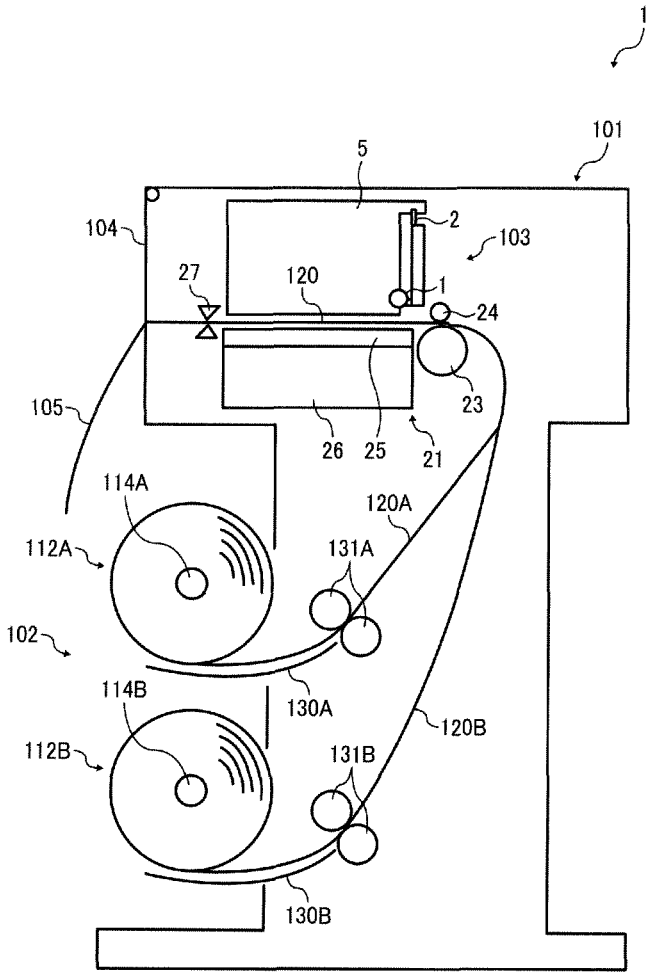
FIG. 2 is a schematic side view of the image forming apparatus.
Figure 3:
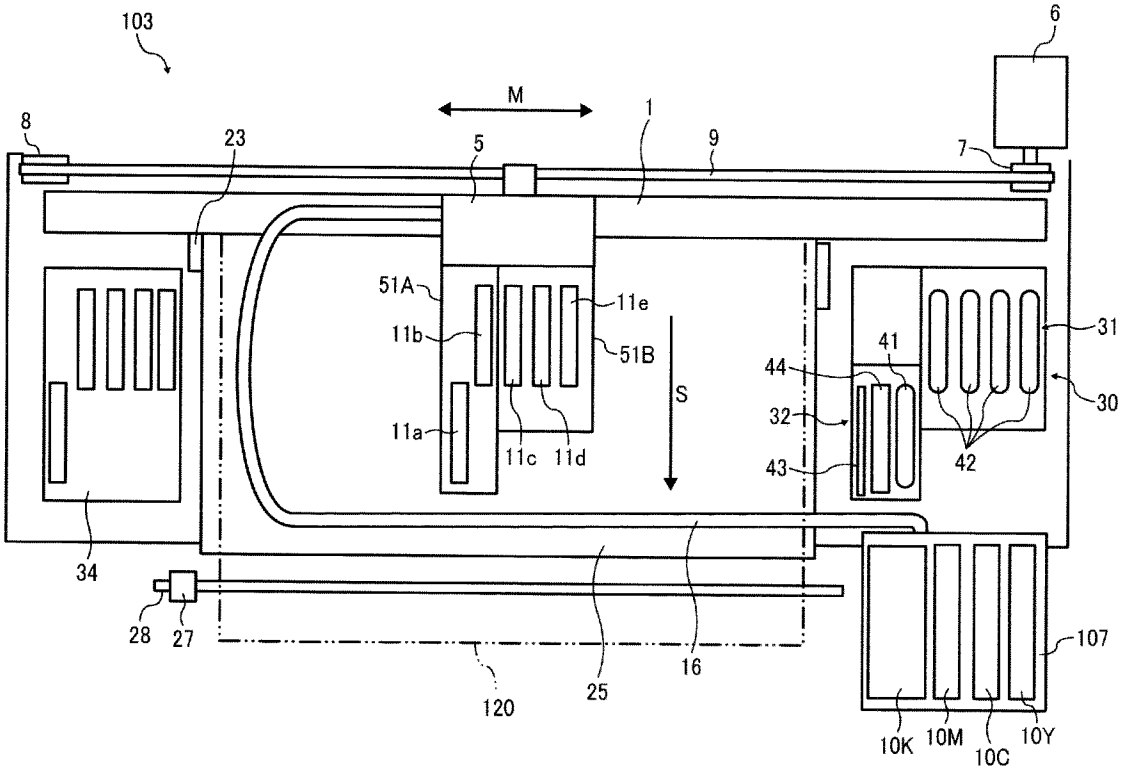
FIG. 3 is a plan view of related parts of a printing mechanical unit of the image forming apparatus.

With reference to FIGS. 1 to 3, an image forming apparatus 1 according to an embodiment of the present invention will be described. FIG. 1 is an external perspective view of the image forming apparatus 1. FIG. 2 is a schematic side view of the image forming apparatus 1. FIG. 3 is a plan view of related parts of a printing mechanical unit of the image forming apparatus 1.

The image forming apparatus 1 is a serial-type image forming apparatus including an apparatus body 101 and a sheet feeder 102 disposed under the apparatus body 101. The sheet feeder 102 disposed under the apparatus body 101 may be provided separately from the apparatus body 101, or may be provided integrally with the apparatus body 101, as illustrated in FIG. 2.

The apparatus body 101 houses a printing mechanical unit 103 that forms an image on a rolled sheet 120, which is a rolled medium (i.e., recording medium) fed from the sheet feeder 102. The rolled sheet 120 printed with the image is cut and discharged from the front side of the apparatus body 101.

The front side of the apparatus body 101 is provided with an access cover 104 configured to open and close relative to the apparatus body 101 to expose the internal printing mechanical unit 103. The access cover 104 is configured to expose at least a moving area of a carriage 5 included in the printing mechanical unit 103. The front side of the apparatus body 101 is also provided with a discharged sheet guide member 105, located below the access cover 104, which guides the discharged rolled sheet 120 and a cartridge installation unit 107, located at one end of the apparatus body 101, in which ink cartridges are installed, as illustrated in FIG. 1.

As illustrated in FIG. 2, the printing mechanical unit 103 includes the cartridge 5, a guide rod 1, and a guide stay 2. The guide rod 1 and the guide stay 2 are guide members held by side plates (not illustrated) and holding the carriage 5 to be movable in a main scanning direction indicated by arrow M in FIG. 3 (hereinafter also referred to as the carriage moving direction).

As illustrated in FIG. 3, the printing mechanical unit 103 further includes a main scanning motor 6, a drive pulley 7, a driven pulley 8, and a timing belt 9, which together form a main scanning mechanical unit for moving the carriage 5 for scanning. The main scanning motor 6 serving as a drive source is disposed on one side in the main scanning direction. The drive pulley 7 is driven to rotate by the main scanning motor 6. The driven pulley 8 is disposed on the other side in the main scanning direction. The timing belt 9 serving as a traction member is stretched around the drive pulley 7 and the driven pulley 8.

As illustrated in FIG. 3, the carriage 5 is mounted with a plurality of recording heads 11. In the present embodiment, the carriage 5 is mounted with five recording heads 11*a* to 11*e* (hereinafter collectively referred to as the recording heads 11 where the distinction therebetween is unnecessary). Each of the recording heads 11 is a liquid ejection head integrated with a head tank from which liquid is supplied to the liquid ejection head.

The plurality of recording heads 11 eject ink droplets of black (K), magenta (M), cyan (C), and yellow (Y) colors, for example. Each of the recording heads 11 includes nozzle rows each having a plurality of nozzles and aligned to extend in a sub-scanning direction indicated by arrow S in FIG. 3 substantially perpendicular to the main scanning direction, and is installed to eject the ink droplets downward.

In the present embodiment, the recording head 11*a* and the recording heads 11*b* to 11*e* are shifted in position in the sub-scanning direction by the length of one recording head 11 (i.e., one nozzle row). Further, each of the recording heads 11*a* to 11*e* includes two nozzle rows. The recording heads 11*a* and 11*b* eject droplets of the same color of black (K), and the recording heads 11*c* to 11*e* eject droplets of the magenta (M), cyan (C), and yellow (Y) colors, respectively.

In the present embodiment, the carriage 5 holds a head holder 51A for the black color and a head holder 51B for the other colors to be attachable to and detachable from the carriage 5. The recording heads 11*a* and 11*b* are mounted on the head holder 51A, and the recording heads 11*c* to 11*e* are mounted on the head holder 51B.

With this configuration, a monochromatic image having a width of two recording heads 11 is formed in one scanning operation performed in the main scanning direction by the recording heads 11*a* and 11*b*, and a color image is formed by, for example, the recording heads 11*c* to 11*e*. It should be noted that the configuration of the recording heads 11 is not limited thereto. For example, all of the recording heads 11 may be aligned in the main scanning direction.

The head tanks of the recording heads 11 are supplied with inks of the respective colors from replaceable ink cartridges 10K, 10M, 10C, and 10Y serving as main tanks (hereinafter referred to as the ink cartridges 10 where the distinction therebetween is unnecessary) via supply tubes 16. The ink cartridges 10 are replaceably installed in the cartridge installation unit 107 provided to the front side of the apparatus body 101 illustrated in FIG. 1. The two recording heads 11*a* and 11*b* that eject the droplets of the same color of black are supplied with the ink from the single ink cartridge 10K.

A main scanning area of the carriage 5, in which the carriage 5 moves in the main scanning direction, includes a recording area in which the rolled sheet 120 fed from the sheet feeder 102 is intermittently transported by a transporting device 21 illustrated in FIG. 2 in a sheet transporting direction corresponding to the sub-scanning direction substantially perpendicular to the main scanning direction of the carriage 5.

The transporting device 21 includes a transport roller 23, a pressure roller 24, a transport guide member 25, and a suction fan 26. The transport roller 23 transports the rolled sheet 120 (i.e., the roller medium) fed from the sheet feeder 102. The pressure roller 24 is disposed facing the transport roller 23. The transport guide member 25 is formed with a multitude of suction holes. The suction fan 26 serves as a suction device that sucks the rolled sheet 120 through the suction holes of the transport guide member 25 to keep the rolled sheet 120 in contact with the transport guide member 25.

As illustrated in FIG. 2, a cutter 27 serving as a cutting device is disposed downstream of the transporting device 21 in the sheet transporting direction such that the rolled sheet 120 having the image formed by the recording heads 11 is cut in a predetermined length by the cutter 27.

The cutter 27 is attached to, for example, a wire or a timing belt 28 illustrated in FIG. 3. The timing belt 28 is stretched around a driven pulley and a drive pulley driven by a drive motor (not illustrated), and is moved in the main scanning direction by the drive motor via the drive pulley to cause the cutter 27 to cut the rolled sheet 120 in the predetermined length.

As illustrated in FIG. 3, a maintenance and restoration mechanism 30 is disposed on one side in the main scanning direction of the carriage 5. The maintenance and restoration mechanism 30 disposed near one side of the transport guide member 25 maintains and restores the performance of the recording heads 11. Further, a preliminary ejection receiver 34 is disposed on the other side in the main scanning direction of the carriage 5. On the preliminary ejection receiver 34 disposed near the other side of the transport guide member 25, preliminary ejection is performed which ejects droplets not contributing to image formation from the recording heads 11.

The maintenance and restoration mechanism 30 includes a first maintenance and restoration unit 31 and a second maintenance and restoration unit 32. The first maintenance and restoration unit 31 is held by a frame of the apparatus body 101. The second maintenance and restoration unit 32 is held by a frame of the maintenance and restoration mechanism 30 to be movable from side to side in the sub-scanning direction. The second maintenance and restoration unit 32 is located at the position illustrated in FIG. 3 when maintaining and restoring the performance of the recording head 11*a*, and moves to the same position as the position of the first maintenance and restoration unit 31 in the sub-scanning direction when maintaining and restoring the performance of the recording heads 11*b* to 11*e*.

The maintenance and restoration mechanism 30 includes a suction cap 41, moisture retention caps 42, a wiper 43, and a preliminary ejection receiver 44, for example. The suction cap 41 also serves as a moisture retention cap that caps a nozzle surface (i.e., a surface formed with nozzles) of each of the recording heads 11. The wiper 43 wipes off the nozzle surface. The preliminary ejection receiver 44 receives preliminarily ejected droplets not contributing to the image formation.

As illustrated in FIG. 2, in the present embodiment, the sheet feeder 102 includes rolls 112A and 112B, guide members 130A and 130B, and transport roller pairs 131A and 131B. The roll 112A disposed in an upper part of the sheet feeder 102 includes an elongated rolled sheet (i.e., rolled medium) 120A wound around a pipe 114A serving as a core member. The roll 112B disposed in a lower part of the sheet feeder 102 includes an elongated rolled sheet (i.e., rolled medium) 120B wound around a pipe 114B serving as a core member. In the following description, the rolls 112A and 112B, the rolled sheets 120A and 120B, the pipes 114A and 114B, the guide members 130A and 130B, and the transport roller pairs 131A and 131B will be referred to as the rolls 112, the rolled sheets 120, the pipes 114, the guide members 130, and the transport roller pairs 131, where the distinction therebetween is unnecessary. Herein, the term "roll" refers to a member combining the pipe 114 and the rolled sheet 120.

In the present embodiment, one end of the rolled sheet 120 of the roll 112 is fixed to the pipe 114 by gluing or the like or not fixed to the pipe 114 by gluing or the like.

The guide members 130 and the transport roller pairs 131 are disposed closer to the apparatus body 101 than the rolls 112 are. The guide member 130 guides the rolled sheet 120 unwound from the roll 112. The transport roller pair 131 feeds the rolled sheet 120 upward in a curved manner.

When the transport roller pair 131 is driven to rotate, the rolled sheet 120 unwound from the roll 112 is transported while being stretched taut between the transport roller pair 131 and the roll 112. Then, the rolled sheet 120 is passed through the transport roller pair 131 and sent through a gap between the transport roller 23 and the pressure roller 24 of the transporting device 21.

The thus-configured image forming apparatus 1 moves the carriage 5 in the main scanning direction and drives the recording heads 11 to eject droplets in accordance with image information (i.e., print information), while causing the transporting device 21 to intermittently transport the rolled sheet 120 fed from the sheet feeder 102, to thereby form a necessary image on the rolled sheet 120. The rolled sheet 120 subjected to the image formation is then cut in the predetermined length by the cutter 27, guided by the discharged sheet guide member 105 provided to the front side of the apparatus body 101, and discharged to the outside of the image forming apparatus 1.

Figure 4:
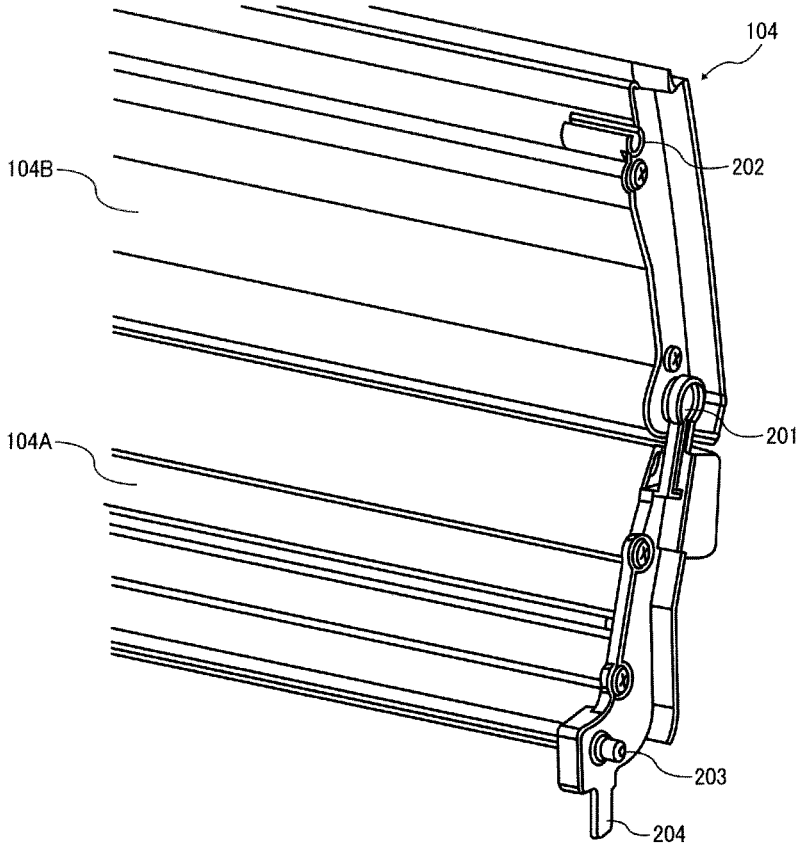
FIG. 4 is a partial perspective view of related parts of an access cover according to a first embodiment of the present invention, as viewed from inside the body of the image forming apparatus.
Figure 5:
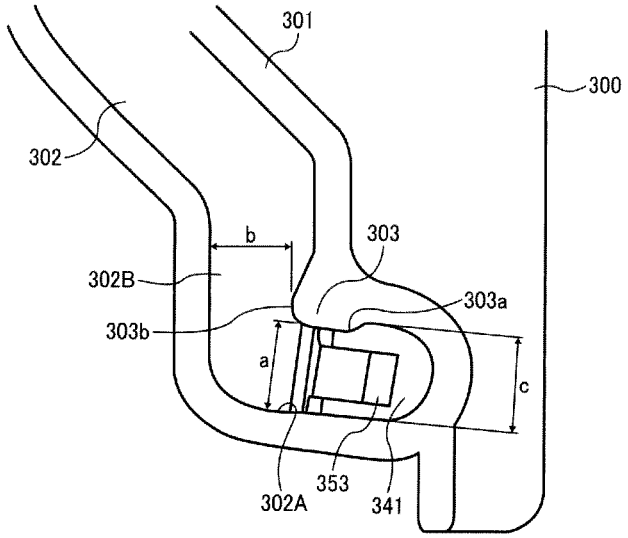
FIG. 5 is a side view of a guide member provided to the body of the image forming apparatus.

With reference to FIGS. 4 and 5, description will now be given of the access cover 104 and a guiding mechanism for guiding the access cover 104 according to a first embodiment of the present invention. FIG. 4 is a partial perspective view of related parts of the access cover 104, as viewed from inside the apparatus body 101. FIG. 5 is a side view of a guide member provided to the apparatus body 101.

As illustrated in FIG. 4, the access cover 104 includes a lower first cover portion 104A and an upper second cover portion 104B, rotatably connected by a shaft 201 to be foldable. Further, each of opposed sides of the access cover 104 includes a hole 202, and projections 203 and 204, only one of each of which is shown in the view illustrated in FIG. 4. The hole 202 fits around a shaft (not illustrated) provided to the apparatus body 101. If a lower end portion of the access cover 104 is moved upward, therefore, the second cover portion 104B rotates about the hole 202, and the access cover 104 folds into two parts at the position of the shaft 201. Thereby, the first cover portion 104A and the second cover portion 104B are folded to open the access cover 104.

The projections 203 projecting outward in the carriage moving direction and the projections 204 projecting downward are provided to opposed end portions in the carriage moving direction of a lower end portion of the first cover portion 104A of the access cover 104. FIG. 4 illustrates the projection 203 and the projection 204 provided on one of the opposed end portions.

As illustrated in FIG. 5, the apparatus body 101 includes a frame 300 provided with guide rails 301 serving as guide members that guide opening and closing movements of the access cover 104. FIG. 5 illustrates the guide rail 301 on one of opposed sides of the frame 300. Each of the guide rails 301 includes a bulge 303 including an entrance portion 303*a* and an exit portion 303*b*, a recess 341, and guide groove 302 including a first guide portion 302A and a second guide portion 302B. The projection 203 of the access cover 104 movably fits in the guide groove 302. FIG. 5 illustrates the guide groove 302 which is disposed on the right side of FIG. 4, as viewed from the side of the access cover 104, and in which the projection 203 illustrated in FIG. 4 fits. The right side of FIG. 5 corresponds to the interior side of the apparatus body 101, and the left side of FIG. 5 corresponds to the front side of the apparatus body 101. An actuator 353 illustrated in FIG. 5 will be described in detail later.

In the guide groove 302, the first guide portion 302A and the second guide portion 302B continuing therefrom guide the access cover 104 into and from a closed state. The first guide portion 302A guides the corresponding projection 203 of the access cover 104 from a fully closed position, which corresponds to an end portion of the guide groove 302, toward the front side of the apparatus body 101 in a first direction being a substantially horizontal direction. The second guide portion 302B guides the projection 203 of the access cover 104 toward the upper side of the apparatus body 101 in a second direction different from the first direction, which is a substantially vertical direction.

The bulge 303 is formed in a wall portion above the boundary between the first guide portion 302A and the second guide portion 302B. That is, in the first guide portion 302A in which the projection 203 of the access cover 104 moves in the first direction from the fully closed position, the width of the guide groove 302 is reduced to a groove width a less than a groove width c by the entrance portion 303*a* of the bulge 303. This configuration prevents the projection 203 of the access cover 104 from moving toward the first guide portion 302A from the fully closed position and slipping out of the guide groove 302 owing to vibration or the like.

Further, in an entrance portion of the second guide portion 302B in which the moving direction of the projection 203 of the access cover 104 shifts from the first direction to the second direction, the width of the guide groove 302 is reduced to a groove width b less than the groove width c by the exit portion 303*b* of the bulge 303. With this configuration, the operation of opening the access cover 104 is slightly slowed down when the moving direction of the projection 203 shifts during the movement from the first guide portion 302A to the second guide portion 302B. As described later, the time from braking the main scanning motor 6 to cutting off power supply to the main scanning motor 6 is extended, thereby reliably stopping the carriage 5 when the access cover 104 is opened.

Figure 6:
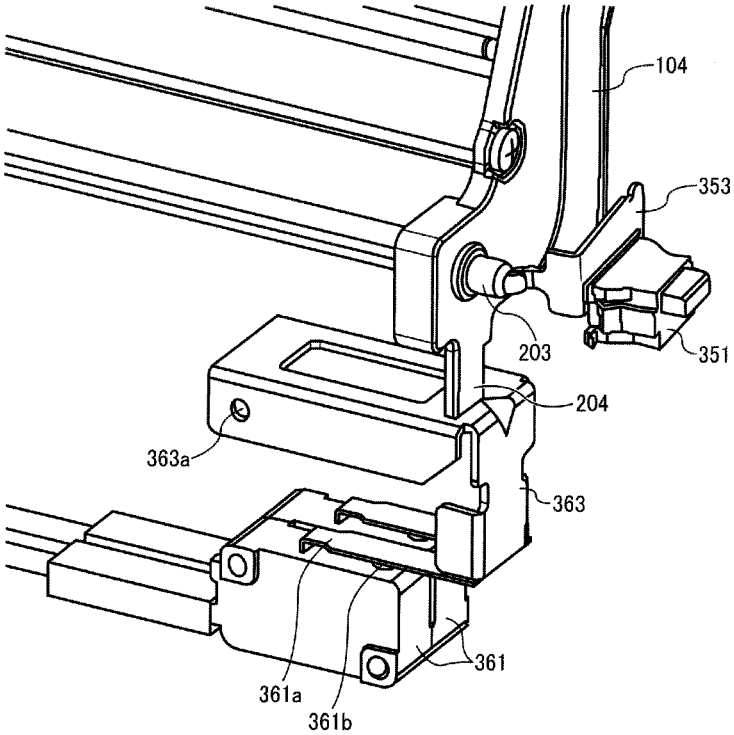
FIG. 6 is a partial perspective view illustrating the configuration of detectors that detect the position of the access cover.
Figure 7A:
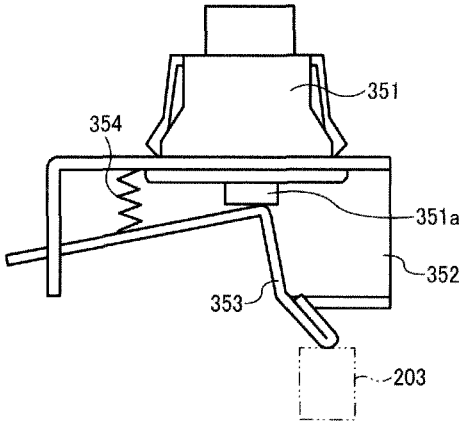
FIGS. 7A and 7B are plan views illustrating the operation of a first detector.
Figure 7B:
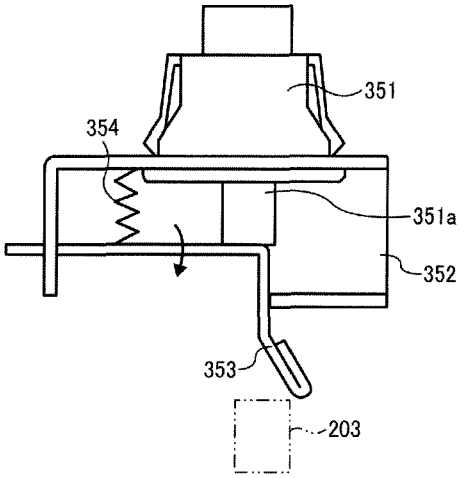
Figure 8A:
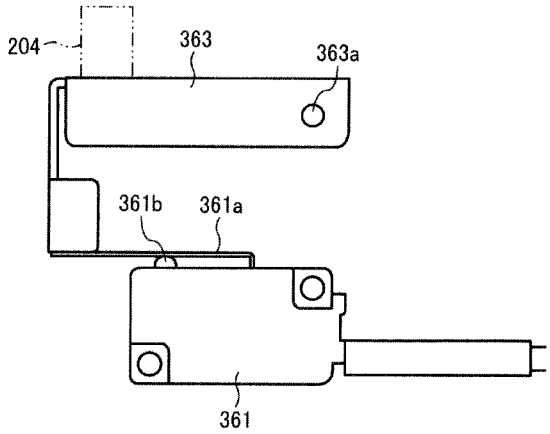
FIGS. 8A and 8B are plan views illustrating the operation of a second detector.
Figure 8B:
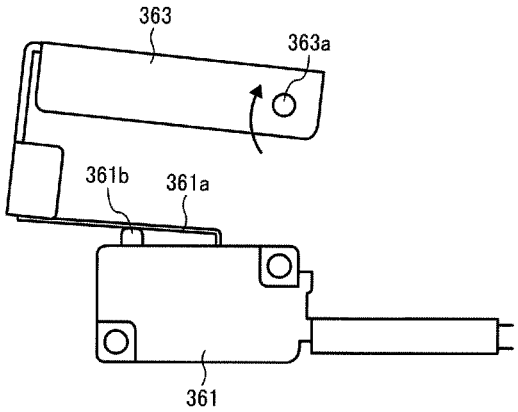

With reference to FIG. 6 to FIG. 8B, description will now be given of the configuration of detectors that detect the position of the access cover 104. FIG. 6 is a partial perspective view of the configuration of the detectors, illustrating a state in which the access cover 104 is located at the fully closed position. FIGS. 7A and 7B are plan views illustrating the operation of a first detector, FIGS. 8A and 8B are plan views illustrating the operation of a second detector.

FIG. 6 illustrates a push-button switch 351, the actuator 353, a microswitch 361 including an actuator piece 361*a* and a button 361*b*, and an actuator 363 including a hole 363*a*. The push-button switch 351 is provided as the first detector which detects that the access cover 104 has been opened from the fully closed position to a first position corresponding to the front position of the first guide portion 302A. That is, the detection by the push-button switch 351 takes place at the first position. The push-button switch 351 outputs a first detection signal upon detection that the access cover 104 has been opened to the first position from the fully closed position.

As illustrated in FIGS. 7A and 7B, the push-button switch 351 including a push button 351*a* is attached to a bracket 352 of the apparatus body 101. The bracket 352 movably holds the actuator 353 that actuates the push button 351*a* of the push-button switch 351. The actuator 353 is pressed in a direction separating from the push button 351*a* by a spring 354, which is a resilient member provided between the actuator 353 and the bracket 352.

As illustrated in FIG. 5, the guide rail 301 includes the recess 341 provided at a position at which the projection 203 is located when the access cover 104 is fully closed. Further, a portion of the actuator 353 is disposed projecting into the guide groove 302 via the recess 341.

When the access cover 104 is located at the fully closed position, therefore, the actuator 353 is pressed toward the push-button switch 351 by the projection 203 of the access cover 104, as illustrated in FIG. 7A. With the actuator 353 pressing the push button 351*a*, the push-button switch 351 is turned on.

When the access cover 104 is opened in the first direction from the fully closed position, the projection 203 of the access cover 104 separates from the actuator 353, as illustrated in FIG. 7B. As a result, the actuator 353 separates from the push button 351*a* of the push-button switch 351 by the resilience of the spring 354, thereby turning off the push-button switch 351.

That is, with the shift of the push-button switch 351 from the ON state to the OFF state, it is detected that the access cover 104 has been moved and opened in the first direction from the fully closed position.

Further, the microswitch 361 is provided as the second detector which detects that the access cover 104 has been opened to a second position corresponding to the upper position of the second guide portion 302B. That is, the detection by the microswitch 361 takes place at the second position, at which the access cover 104 is more open than at the first position. The microswitch 361 outputs a second detection signal upon detection that the access cover 104 has been opened to the second position.

The microswitch 361 is fixed to a bracket (not illustrated) provided to the apparatus body 101. In the microswitch 361, the actuator piece 361*a* is configured to press the button 361*b*. When the actuator piece 361*a* presses the button 361*b*, the microswitch 361 turns on.

The actuator 363 that comes into contact with the actuator piece 361 of the microswitch 361 is disposed above the microswitch 361. The actuator 363 is configured to swing about a shaft (not illustrated) passing through hole the 363*a*.

When the access cover 104 is located at the fully closed position or in the first guide portion 302A, the actuator 363 is located at a position at which the actuator 363 is pressed by the projection 204. That is, when the projection 203 of the access cover 104 has moved to the second guide portion 302B through the bulge 303, the actuator 363 is located at a position at which the projection 204 of the access cover 104 is separated from the actuator 363.

Accordingly, when the projection 203 of the access cover 104 is located between the bulge 303 of the guide rail 301 and the fully closed position, the actuator 363 is pressed by the projection 204 of the access cover 104, as illustrated in FIG. 8A. With the actuator 363 thus pressed, the actuator piece 361*a* of the microswitch 361 is pressed to press the button 361*b*, thereby turning on the microswitch 361.

When the access cover 104 is opened to the position at which the projection 203 of the access cover 104 has moved to the second guide portion 302B from the first guide portion 302A through the bulge 303, the projection 204 of the access cover 104 separates from the actuator 363, as illustrated in FIG. 8B. As a result, the actuator piece 361*a* of the microswitch 361 separates from the button 361*b* while pressing the actuator 363 owing to the resilience of the button 361*b*, thereby turning off the microswitch 361.

That is, with the shift of the microswitch 361 from the ON state to the OFF state, it is detected that the access cover 104 has been shifted in moving direction from the first direction to the second direction and opened to the upper position of the second guide portion 302B.

With reference to the partial perspective view of FIG. 9, description will now be given of a state in which the access cover 104 is opened from the fully closed position by a predetermined amount.

Figure 9:
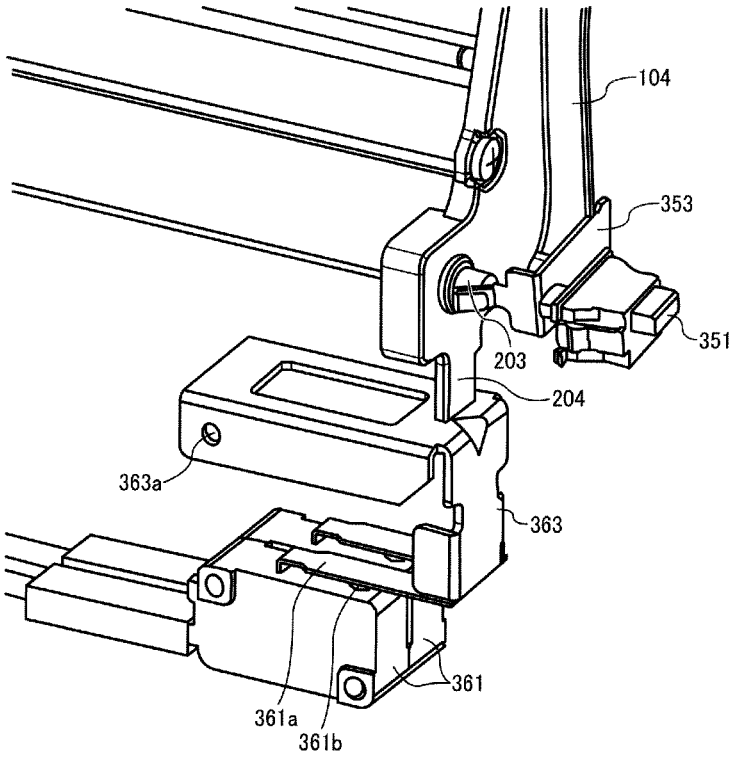
FIG. 9 is a partial perspective view illustrating a state in which the access cover is opened from a fully closed position by a predetermined amount.

In FIG. 9, the access cover 104 is opened from the fully closed position to the front position of the first guide portion 302A by a predetermined amount. In this state, the push-button switch 351 is in the OFF state with the projection 203 separated from the actuator 353, and the microswitch 361 is in the ON state with the projection 204 of the access cover 104 contacting the actuator 363.

Figure 10:
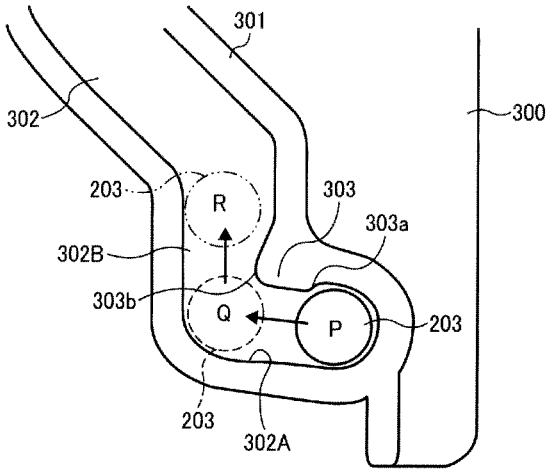
FIG. 10 is a side view illustrating the movement of a projection of the access cover in a guide groove.

With reference to the side view of FIG. 10, description will now be given of the movement of the projection 203 of the access cover 104 in the guide groove 302.

When the access cover 104 is located at the fully closed position, the projection 203 is located at a position P, and the push-button switch 351 and the microswitch 361 are both in the ON state, as described above.

When the projection 203 enters the first guide portion 302A and moves to a position Q in accordance with the operation of opening the access cover 104, the push-button switch 351 turns off during the movement of the projection 203, as described above. The microswitch 361 remains in the ON state in this process.

When the projection 203 enters the second guide portion 302B and further moves to a position R in accordance with the operation of opening the access cover 104, the microswitch 361 also turns off, as described above.

Figure 11:
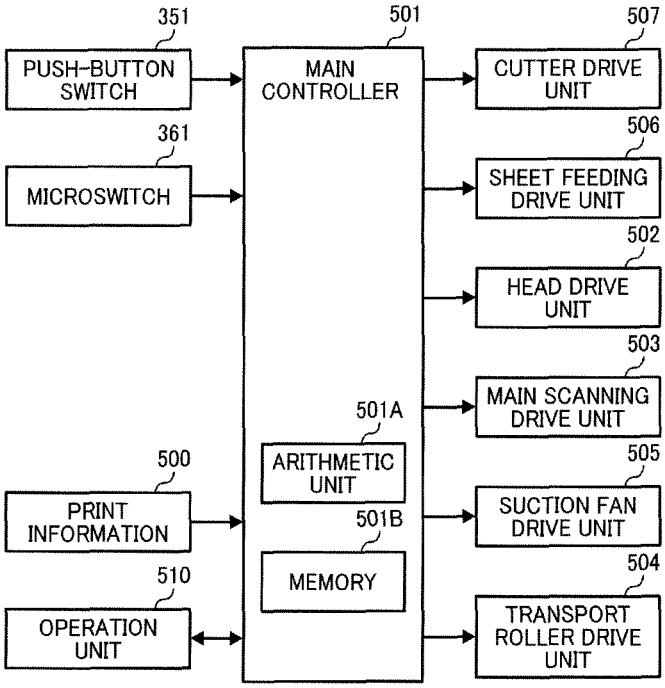
FIG. 11 is a block diagram illustrating an overview of a controller.

With reference to the block diagram of FIG. 11, an overview of a controller of the image forming apparatus 1 will be described.

A main controller 501 is a microcomputer including a central processing unit (CPU), a read only memory (ROM), a random access memory (RAM), and input/output (I/O) interfaces. In the main controller 501, the CPU forms an arithmetic unit 501A, and the ROM and the RAM form a memory 501B. The main controller 501 also serves as a device that brakes the main scanning motor 6 serving as the drive source for moving the carriage 5 and cuts off the power supply to the main scanning motor 6.

The main controller 501 receives print information 500 input from a host apparatus. Then, to form an image according to the print information 500, the main controller 501 drives the transport roller pair 131 via a sheet feeding drive unit 506 to feed and transport the rolled sheet 120 from the roll 112 installed in the upper or lower part of the sheet feeder 102.

Further, the main controller 501 controls the driving of the main scanning motor 6 via a main scanning drive unit 503 to move the carriage 5 for scanning in the main scanning direction. The main controller 501 further drives the transport roller 23 to rotate via a transport roller drive unit 504 and drives the suction fan 26 via a suction fan drive unit 505, to thereby move the rolled sheet 120 in the sub-scanning direction. Further, the main controller 501 controls the driving of the recording heads 11 via a head drive unit 502 in accordance with the print information 500 to eject necessary droplets from the recording heads 11 and thereby form a necessary image on the rolled sheet 120. Further, the main controller 501 drives the cutter 27 via a cutter drive unit 507 to cut the image-formed rolled sheet 120 in a necessary length. Further, the main controller 501 is connected to an operation unit 510. Information such as the type of the rolled sheet 120 to be used may be input to the main controller 501 from the operation unit 510 or from the host apparatus connected to the image forming apparatus 1.

The main controller 501 also receives the first detection signal input from the push-button switch 351 and the second detection signal input from the microswitch 361 described above.

Figure 12:
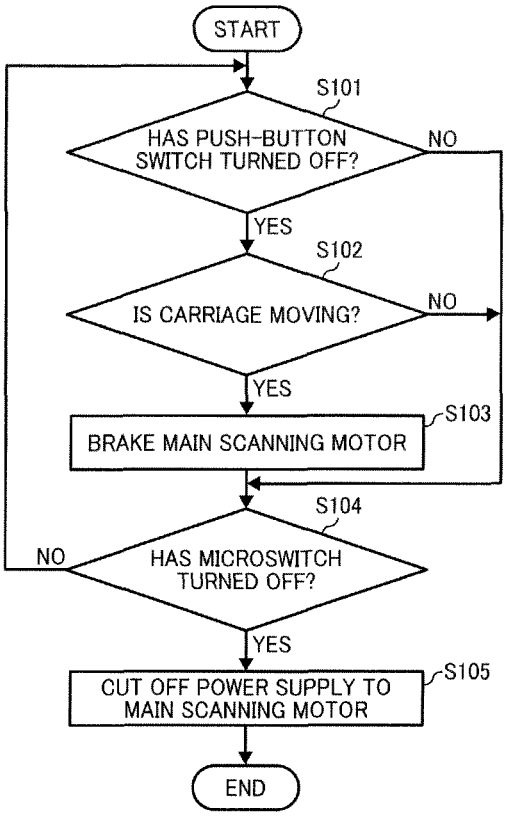
FIG. 12 is a flowchart illustrating a first example of the control performed by the controller on a main scanning motor when the access cover is opened.

With reference to the flowchart of FIG. 12, description will now be given of a first example of the control performed by the main controller 501 on the main scanning motor 6 when the access cover 104 is opened.

In the first example, the main controller 501 determines whether or not the push-button switch 351 has turned off (step S101). If the push-button switch 351 has turned off (YES at step S101), the main controller 501 determines whether or not the carriage 5 is moving (step S102). If the carriage 501 is moving (YES step S102), the main controller 501 brakes the main scanning motor 6 while continuing the power supply to the main scanning motor 6 (step S103). The main controller 501 may brake the main scanning motor 6 by, for example, supplying the main scanning motor 6 with a voltage for rotating the main scanning motor 6 in the inverse direction for a predetermined time or by short-circuiting the main scanning motor 6 for a predetermined time.

Thereafter, the main controller 501 determines whether or not the microswitch 361 has turned off (step S104). If the microswitch 361 has turned off (YES at step S104), the main controller 501 cuts off the power supply to the main scanning motor 6 (step S105). In the present example, the main controller 501 cuts off the power supply to the main scanning motor 6 by turning off a switch (not illustrated) provided on a power feed path to the main scanning motor 6. Alternatively, the microswitch 361 may be provided on the power feed path, as described later, to mechanically cut off the power feed path by using the microswitch 361.

As described above, when the push-button switch 351 serving as the first detector detects that the access cover 104 has been opened to the first position, the main controller 501 brakes the main scanning motor 6 serving as the drive source of the carriage 5. Further, when the microswitch 361 serving as the second detector detects that the access cover 104 has also been opened to the second position, the main controller 501 cuts off the power supply to the main scanning motor 6 serving as the drive source of the carriage 5.

With this configuration, the power supply to the main scanning motor 6 serving as the drive source of the carriage 5 is cut off after the main scanning motor 6 is braked. If the access cover 104 is opened during the movement of the carriage 5, therefore, the moving speed of the carriage 5 is sufficiently reduced. Accordingly, if the access cover 104 is opened and the internal mechanical section of the image forming apparatus 1 is accessed from outside (e.g., accessed by a user), the carriage 5 is prevented from continuing to move by inertia owing to the cut-off of the power supply without a reduction in moving speed of the carriage 5.

When the access cover 104 is opened, the carriage 5 is not required to be completely stopped, but is desired to have been sufficiently reduced in speed to ensure safety (e.g., to protect the carriage 5 from an external object). Preferably, the detection time of each of the push-button switch 351 (i.e., the first detector) and the microswitch 361 (i.e., the second detector) is set such that the carriage 5 is stopped when the access cover 104 is opened. More preferably, the carriage 5 is stopped before the detection of the microswitch 361 serving as the second detector.

Figure 13:
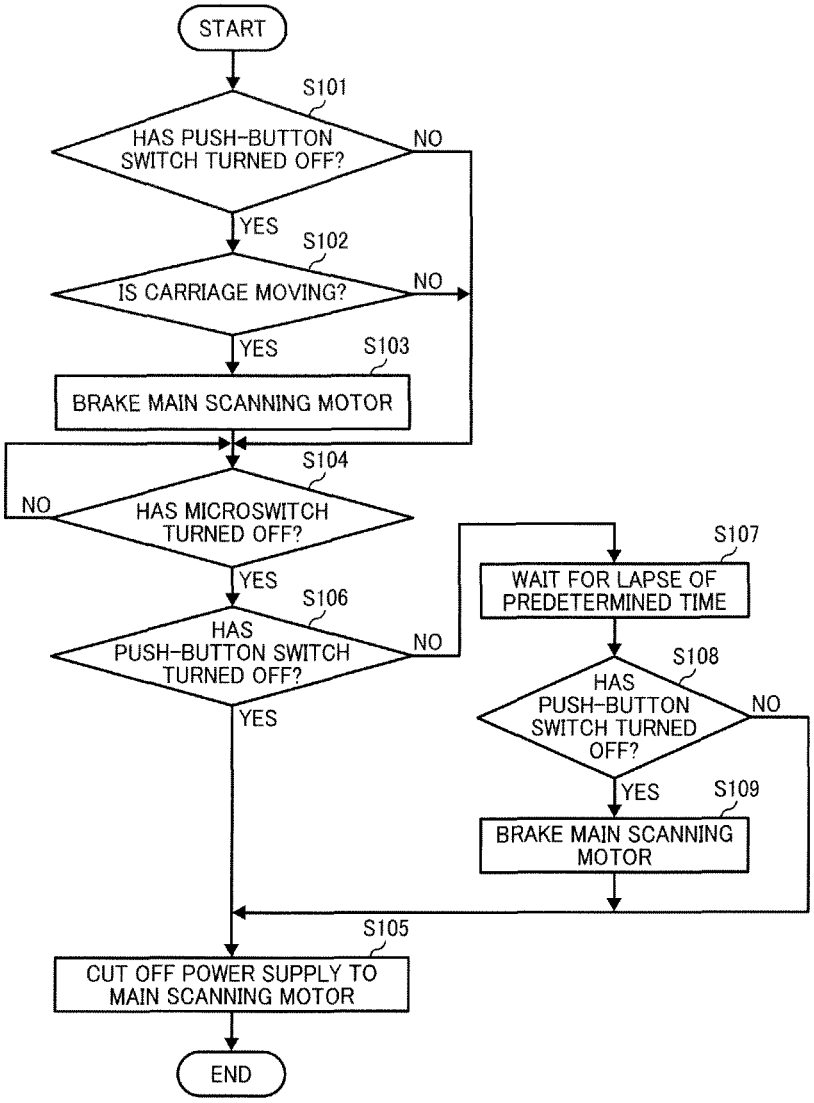
FIG. 13 is a flowchart illustrating a second example of the control.

With reference to the flowchart of FIG. 13, description will now be given of a second example of the control performed by the main controller 501 on the main scanning motor 6 when the access cover 104 is opened.

In the second example, the main controller 501 determines whether or not the microswitch 361 has turned off (step S104) also when the push-button switch 351 is in the ON state (NO at step S101), as in the above-described first example. Then, if the microswitch 361 has turned off (YES at step S104), the main controller 501 again determines whether or not the push-button switch 351 has turned off (step S106), and performs the following steps.

If the push-button switch 351 has turned off (YES at step S106), the main controller 501 cuts off the power supply to the main scanning motor 6. If the push-button switch 351 has not turned off (NO at step S106), the main controller 501 waits for the lapse of a predetermined time, e.g., approximately 100 milliseconds (step S107), and then again determines whether or not the push-button switch 351 has turned off (step S108).

Then, if the push-button switch 351 has turned off after the lapse of the predetermined time (YES at step S108), the main controller 501 brakes the main scanning motor 6 (step S109), and then cuts off the power supply to the main scanning motor 6 (step S105). If the push-button switch 351 has not turned off after the lapse of the predetermined time (NO at step S108), the main controller 501 cuts off the power supply to the main scanning motor 6 (step S105).

That is, if the first detection signal indicating that the access cover 104 has been opened to the first position has not been output from the push-button switch 351 (i.e., the first detector) even when the second detection signal indicating that the access cover 104 has been opened to the second position has been output from the microswitch 361 (i.e., the second detector) (NO at step S106), and if the first detection signal indicating that the access cover 104 has been opened to the first position has been output from the push-button switch 351 within the predetermined time (YES at step S108), the main controller 501 brakes the main scanning motor 6 and then cuts off the power supply to the main scanning motor 6.

The above-described steps are performed for the following reason. In some cases, the actuator 353 provided to the push-button switch 351 momentarily gets caught in another component or the like during the opening of the access cover 104, thereby causing an error in which an OFF signal of the microswitch 361 (i.e., the second detection signal) is detected before the detection of the OFF signal of the push-button switch 351 (i.e., the first detection signal). In such an error mode, if the power supply to the main scanning motor 6 is cut off upon detection of the OFF signal of the microswitch 361, the power supply to the main scanning motor 6 is cut off without a reduction in speed of the carriage 5. As a result, the carriage 5 continues to move by inertia, and thus may come into contact with an external object (e.g., a hand or finger of the user) when the access cover 104 is opened.

When the OFF signal of the microswitch 361 is detected, therefore, the main controller 501 checks whether or not the push-button switch 351 has turned off, without immediately cutting off the power supply. Then, if the push-button switch 351 has not turned off, the main controller 501 determines that an error is caused, and executes the steps for the error mode.

In the error mode, the main controller 501 again checks whether or not the push-button switch 351 has turned off after the lapse of the predetermined time. If the push-button switch 351 has turned off after the lapse of the predetermined time, the main controller 501 brakes the main scanning motor 6, and then cuts off the power supply to the main scanning motor 6. In the above-described case in which the actuator 353 provided to the push-button switch 351 gets caught in another component or the like, therefore, the normal opening operation of the access cover 104 is performed, although the operation is delayed by the predetermined time.

Meanwhile, if the access cover 104 is opened when the push-button switch 351 has not turned off after the lapse of the predetermined time, the carriage 5 is being normally driven when the access cover 104 is opened. Therefore, the power supply to the main scanning motor 6 is forcibly cut off to cause the carriage 5 to move only by inertia.

The above-described predetermined time is set to a possible standby time in consideration of, for example, the time taken to perform the opening operation of the access cover 104, the time taken from braking the main scanning motor 6 to cutting off the power supply to the main scanning motor 6, and the time taken to sufficiently reduce the speed of the inertial motion of the carriage 5 caused by the forcible cut-off of the power supply.

With reference to the block diagram of FIG. 14, description will now be given of a third example of the control performed by the main controller 501 on the main scanning motor 6 when the access cover 104 is opened.

In the third example, the control to brake (i.e., stop) the main scanning motor 6 is performed by the main controller 501 on the basis of the detection of the OFF signal of the push-button switch 351 serving as the first detector.

Figure 14:
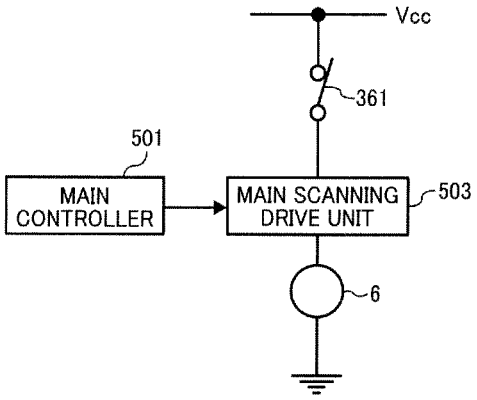
FIG. 14 is a block diagram illustrating a third example of the control.

Further, as illustrated in FIG. 14, the microswitch 361 is provided on the power feed path to the main scanning motor 6 to mechanically cut off the power feed path and thereby cut off the power supply to the main scanning motor 6. With the power feed path thus mechanically cut off by the microswitch 361, the power supply to the main scanning motor 6 is reliably cut off.

Figure 15:
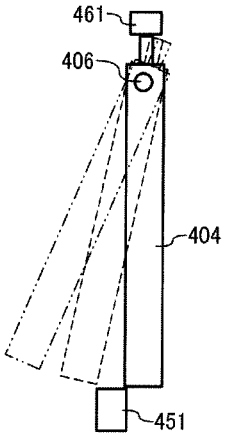
FIG. 15 is a schematic side view illustrating an access cover according to a second embodiment of the present invention.

With reference to the schematic side view of FIG. 15, an access cover according to a second embodiment of the present invention will now be described.

An access cover 404 according to the second embodiment is configured as a single cover having an upper portion rotatably held by a shaft 406. According to the second embodiment, a first detector 451 and a second detector 461 are provided. The first detector 451 turns off (or on) when the access cover 404 is opened from a fully closed position indicated by a solid line to a first position indicated by a dashed line. The second detector 461 turns off (or on) when the access cover 404 is opened to a second position indicated by a dash double-dotted line.

If the thus configured second embodiment has the configuration of the foregoing third example, for instance, it is possible to brake the main scanning motor 6 on the basis of a detection signal of the first detector 451 to stop the main scanning motor 6, and cut off the power feed path to the main scanning motor 6 on the basis of a detection signal of the second detector 461 to cut off the power supply to the main scanning motor 6.

According to the embodiments of the present invention, the carriage 5 is promptly and reliably stopped when the access cover 104 or 404 is opened.

In the present specification, the term "sheet" is not limited to a paper material, and refers to a material such as an overhead projector (OHP) sheet, fabric, glass, or a substrate, to which droplets of ink or other kinds of liquid adhere. The sheet may also be referred to as a recorded medium, a recording medium, a recording sheet, or recording paper, for example. Further, the terms "image formation," "recording," and "printing" are synonymously used.

Further, the term "image forming apparatus" refers to an apparatus that performs image formation by ejecting liquid onto a medium such as paper, thread, fiber, cloth, leather, metal, plastic, glass, wood, or ceramics, for example. The image forming apparatus includes both a serial-type image forming apparatus and a line-type image forming apparatus. The term "image formation" refers to providing a medium with a meaningful image such as a character or a figure and also providing a medium with a meaningless image such as a pattern (i.e., simple ejection of droplets onto a medium).

Further, the term "ink" is not limited to so-called ink, and is used to collectively refer to various types of liquid with which the image formation is performed, such as recording liquid and fixing liquid. The ink may be a deoxyribonucleic acid (DNA) sample, a resist material, a pattern material, or a resin, for example.

Further, the term "image" is not limited to a planar image, and includes an image formed on a three-dimensionally shaped object and a three-dimensionally formed image.

Further, although the image forming apparatus of the above-described embodiments uses a rolled sheet, the present invention is similarly applicable to an image forming apparatus using a substantially flat sheet.

Further, although the first and second detectors of the above-described embodiments are contact-type detectors, the first and second detectors may be configured as non-contact-type detectors, such as photosensors. To reliably cut off the power supply, however, it is desirable to configure the first and second detectors as mechanical switches serving as contact-type detectors.

The above-described embodiments and effects thereof are illustrative only and do not limit the present invention. Thus, numerous additional modifications and variations are possible in light of the above teachings. For example, elements or features of different illustrative embodiments herein may be combined with or substituted for each other within the scope of this disclosure and the appended claims. Further, features of components of the embodiments, such as number, position, and shape, are not limited to those of the disclosed embodiments and thus may be set as preferred. Further, the above-described steps are not limited to the order disclosed herein. It is therefore to be understood that, within the scope of the appended claims, the disclosure of the present invention may be practiced otherwise than as specifically described herein.

What is claimed is:

1. An image forming apparatus comprising:

an access cover configured to open and close relative to a body of the image forming apparatus;

a carriage configured to include an image forming device and move in a moving area inside the image forming apparatus which is exposed when the access cover is opened;

a first detector configured to detect that the access cover has been opened from a fully closed position to a first position;

a second detector configured to detect that the access cover to the body of the image forming apparatus has been opened to a second position at which the access cover is more open than at the first position;

a drive source supplied with power and configured to drive the carriage to move; and a controller that brakes the drive source while the drive source is being supplied with power when the first detector detects that the access cover to the body of the image forming apparatus has been opened to the first position, and cuts off power supply to the drive source when the second detector detects that the access cover has been opened to the second position, wherein the access cover is configured to move from the fully closed position in a first direction and then in a second direction different from the first direction, wherein the access cover includes projections provided at opposed end portions thereof in a moving direction of the carriage, wherein the body of the apparatus includes guide grooves in which the projections of the access cover movably fit in, and wherein each of the guide grooves is reduced in width in at least one of a first portion in which the access cover moves from the fully closed position in the first direction and a second portion in which the access cover changes in moving direction from the first direction to the second direction.

2. The image forming apparatus according to claim 1, wherein the first detector is provided at a position at which the first detector detects that the access cover has been moved from the fully closed position in the first direction and opened to the first position, and wherein the second detector is provided at a position at which the second detector detects that the access cover has been changed in moving direction from the first direction to the second direction and opened to the second position.

3. The image forming apparatus according to claim 2, wherein the first direction is substantially horizontal and the second direction is substantially vertical.

4. The image forming apparatus according to claim 1, wherein at least one of the first detector and the second detector is a contact-type detector.

5. The image forming apparatus according to claim 1, wherein the access cover includes a first cover portion and a second cover portion which are foldably connected.

6. An image forming apparatus comprising:

an access cover configured to open and close relative to a body of the image forming apparatus;

a carriage configured to include an image forming device and move in a moving area inside the image forming apparatus which is exposed when the access cover is opened;

a first detector configured to detect that the access cover has been opened from a fully closed position to a first position;

a second detector configured to detect that the access cover has been opened to a second position at which the access cover is more open than at the first position;

a drive source supplied with power and configured to drive the carriage to move; and a controller that brakes the drive source while the drive source is being supplied with power when the first detector detects that the access cover has been opened to the first position, and cuts off power supply to the drive source when the second detector detects that the access cover has been opened to the second position, wherein the first detector outputs a first signal when detecting that the access cover has been opened to the first position, and the second detector outputs a second signal when detecting that the access cover has been opened to the second position, and wherein the controller brakes the drive source while the drive source is being supplied with power and then cuts off power supply to the drive source if the second signal is output when the first signal is not output, and if the first signal is output within a predetermined time after the output of the second signal.

7. The image forming apparatus according to claim 6, wherein the access cover is configured to move from the fully closed position in a first direction and then in a second direction different from the first direction, wherein the first detector is provided at a position at which the first detector detects that the access cover has been moved from the fully closed position in the first direction and opened to the first position, and wherein the second detector is provided at a position at which the second detector detects that the access cover has been changed in moving direction from the first direction to the second direction and opened to the second position.

8. The image forming apparatus according to claim 7, wherein the first direction is substantially horizontal and the second direction is substantially vertical.

9. The image forming apparatus according to claim 7, wherein the access cover includes projections provided at opposed end portions thereof in a moving direction of the carriage, wherein the body of the apparatus includes guide grooves in which the projections of the access cover movably fit in, and wherein each of the guide grooves is reduced in width in at least one of a first portion in which the access cover moves from the fully closed position in the first direction and a second portion in which the access cover changes in moving direction from the first direction to the second direction.

10. The image forming apparatus according to claim 6, wherein at least one of the first detector and the second detector is a contact-type detector.

11. The image forming apparatus according to claim 6, wherein the access cover includes a first cover portion and a second cover portion which are foldably connected.

* * * * *